US012161172B2

(12) United States Patent
Miller et al.

(10) Patent No.: US 12,161,172 B2
(45) **Date of Patent: *Dec. 10, 2024**

(54) BRA WITH STRETCH SUPPORT

(71) Applicant: Under Armour, Inc., Baltimore, MD (US)

(72) Inventors: Merida Miller, Baltimore, MD (US); Jason Berns, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/457,545

(22) Filed: Aug. 29, 2023

(65) Prior Publication Data

US 2024/0156182 A1 May 16, 2024

Related U.S. Application Data

(63) Continuation of application No. 17/894,088, filed on Aug. 23, 2022, now Pat. No. 11,737,499, which is a continuation of application No. 16/875,590, filed on May 15, 2020, now Pat. No. 11,464,262, which is a continuation of application No. 16/104,511, filed on Aug. 17, 2018, now Pat. No. 10,681,941, which is a continuation of application No. 15/708,981, filed on Sep. 19, 2017, now Pat. No. 10,051,896, which is a continuation of application No. 14/616,365, filed on Feb. 6, 2015, now Pat. No. 9,788,579.

(60) Provisional application No. 61/937,167, filed on Feb. 7, 2014.

(51) Int. Cl.
*A41C 3/00* (2006.01)

(52) U.S. Cl.
CPC ..... *A41C 3/0057* (2013.01); *A41C 3/0085* (2013.01); *A41B 2500/50* (2013.01)

(58) Field of Classification Search
CPC .. A41C 3/0085; A41C 3/0057; A41B 2500/50
See application file for complete search history.

(56) References Cited

U.S. PATENT DOCUMENTS

| | | | |
|---|---|---|---|
| 3,537,279 | A | 11/1970 | Epley |
| 4,091,819 | A | 5/1978 | Huber et al. |
| 4,701,964 | A | 10/1987 | Bell et al. |
| 4,776,916 | A | 10/1988 | Prunesti |
| 5,340,352 | A | 8/1994 | Nakanishi et al. |
| 5,592,836 | A | 1/1997 | Schuster et al. |

(Continued)

*Primary Examiner* — Gloria M Hale
(74) *Attorney, Agent, or Firm* — Maginot, Moore & Beck, LLP

(57) ABSTRACT

A brassiere includes a front portion configured to be positioned along a front of a torso, a back portion coupled to the front portion, and a shoulder strap extending from the front portion to the back portion. The front portion includes a cup for supporting a wearer's breast. The cup comprises a fabric layer and a printed layer. The fabric layer includes a first side and a second side opposite the first side. The printed layer is deposited on the fabric layer and forms a discontinuous layer defining covered fabric areas and noncovered fabric areas exposing the fabric layer. An elastic modulus of the covered fabric areas is different than an elastic modulus of the noncovered fabric areas. The printed layer is deposited on the fabric layer in a pattern configured to provide the cup with an elastic modulus gradient.

20 Claims, 8 Drawing Sheets

(56) References Cited

U.S. PATENT DOCUMENTS

| | | | | |
|---|---|---|---|---|
| 5,916,829 | A | 6/1999 | Girard | |
| 6,180,178 | B1 | 1/2001 | Vogt | |
| 6,287,168 | B1 | 9/2001 | Rabinowicz | |
| 6,540,585 | B1 | 4/2003 | Lee | |
| 6,685,534 | B2 | 2/2004 | Mitchell et al. | |
| 6,769,358 | B2 | 8/2004 | Jordan | |
| 7,081,035 | B2 | 7/2006 | Kawakami | |
| 7,163,432 | B2 | 1/2007 | Mitchell et al. | |
| 7,214,120 | B2 | 5/2007 | Kaye et al. | |
| 7,435,155 | B2 | 10/2008 | Reinisch et al. | |
| 7,442,110 | B2 | 10/2008 | Gaudet et al. | |
| 7,631,367 | B2 | 12/2009 | Caillibotte et al. | |
| 7,862,401 | B2 | 1/2011 | Watrin et al. | |
| 8,128,457 | B2 | 3/2012 | Reinisch et al. | |
| 8,262,432 | B2 | 9/2012 | Sokolowski | |
| 9,149,076 | B2 | 10/2015 | Almog | |
| 9,233,520 | B2 | 1/2016 | Kelsey | |
| 9,238,344 | B2 | 1/2016 | Kelsey | |
| 9,788,579 | B2 * | 10/2017 | Miller | A41C 3/0085 |
| 10,051,896 | B2 * | 8/2018 | Miller | A41C 3/0057 |
| 10,681,941 | B2 * | 6/2020 | Miller | A41C 3/0085 |
| 11,464,262 | B2 * | 10/2022 | Miller | A41C 3/0085 |
| 11,737,499 | B2 * | 8/2023 | Miller | A41C 3/0085 450/65 |
| 2003/0171066 | A1 | 9/2003 | Mitchell et al. | |
| 2003/0171067 | A1 | 9/2003 | Mitchell | |
| 2004/0198178 | A1 | 10/2004 | Mitchell et al. | |
| 2006/0021388 | A1 | 2/2006 | Mitchell et al. | |
| 2006/0240743 | A1 | 10/2006 | Mitchell | |
| 2007/0021035 | A1 | 1/2007 | Bugada | |
| 2007/0049163 | A1 | 3/2007 | Lin | |
| 2007/0082579 | A1 | 4/2007 | Baran et al. | |
| 2008/0268748 | A1 | 10/2008 | Huang et al. | |
| 2009/0117824 | A1 | 5/2009 | Jian | |
| 2010/0267312 | A1 | 10/2010 | Chien | |
| 2011/0143633 | A1 | 6/2011 | Zhang | |
| 2015/0223525 | A1 | 8/2015 | Miller et al. | |
| 2018/0000167 | A1 | 1/2018 | Miller | |

* cited by examiner

BRA WITH STRETCH SUPPORT

CROSS-REFERENCE TO RELATED APPLICATIONS

This application is a continuation of U.S. patent application Ser. No. 17/894,088, filed Aug. 23, 2022 (now U.S. Pat. No. 11,737,499), which application is a continuation of U.S. patent application Ser. No. 16/875,590, filed May 15, 2020 (now U.S. Pat. No. 11,464,262), which is a continuation of U.S. patent application Ser. No. 16/104,511, filed Aug. 17, 2018 (now U.S. Pat. No. 10,681,941), which is a continuation of U.S. patent application Ser. No. 15/708,981, filed Sep. 19, 2017 (now U.S. Pat. No. 10,051,896), which is a continuation of U.S. patent application Ser. No. 14/616,365, filed Feb. 6, 2015 (now U.S. Pat. No. 9,788,579), which claims priority from U.S. provisional patent application No. 61/937,167, filed Feb. 7, 2014.

FIELD

This disclosure relates to the field of bras and particularly to bras having enhanced support.

BACKGROUND

Brassieres or bras are worn by many women to support their breasts and to facilitate a desirable shape and appearance. Bras are made with a variety of constructions to provide different amounts of support to different areas of the breasts. The type of bra selected to be worn by a woman is influenced by her personal preferences regarding appearance and comfort as well as by the activity to be performed while she is wearing the bra. For example, a sports bra is a type of bra that is generally casual in appearance and provides more support to the woman's breasts, reducing movement of the breasts during physical exercise. Sports bras generally provide additional support by encapsulating and/or compressing the breasts. Sports bras that encapsulate the breasts usually have molded cups which separate the breasts and provide support around each breast, whereas sports bras that compress the breasts usually apply uniform pressure to flatten the breasts against the chest.

Women often prefer to wear sports bras during physical exercise to reduce movement of the breasts and resulting discomfort. Different types of physical exercise can result in varying amounts of breast movement. For example, performing a low-impact exercise, like yoga, will generally cause less breast movement than performing a high-impact exercise, like running. Additionally, larger breasts will generally move more during physical exercise than smaller breasts. Accordingly, women may prefer to wear sports bras having a wide variety of amounts and types of support. Additionally, a woman may prefer to wear different types of sports bras for different types of physical exercise.

For women who have larger breasts and who wish to perform high-impact activities, prior sports bras may not provide adequate support to reduce movement and resulting discomfort. Accordingly, it is desirable to provide an improved sports bra. It would be advantageous if the sports bra could provide adequate support for women having larger breasts and/or women who wish to perform high-impact activities. It would also be advantageous if a minimum number of components could be added to the construction of the improved sports bra to keep the costs of materials and production lower.

SUMMARY

In accordance with one embodiment of the disclosure, there is provided a brassiere comprising a cup for supporting a wearer's breast. The cup comprises a fabric layer and a printed layer. The fabric layer includes a first side and a second side opposite the first side. The printed layer is deposited on the fabric layer and forms a discontinuous layer defining covered fabric areas and noncovered fabric areas exposing the fabric layer. An elastic modulus of the covered fabric areas is different than an elastic modulus of the noncovered fabric areas. The printed layer is deposited on the fabric layer in a pattern configured to provide the cup with an elastic modulus gradient.

In accordance with another embodiment of the disclosure, there is provided an article of apparel comprising a front portion configured to be positioned along a front of a torso, a back portion coupled to the front portion, and a shoulder strap extending from the front portion to the back portion. The shoulder strap includes a fabric layer including a first side and second side opposite the first side, and a discontinuous polymer layer deposited onto the second side of the fabric layer. The polymer layer forms covered fabric areas where the polymer is applied to the fabric layer and openings where the polymer is not applied to the fabric layer, thereby exposing the fabric layer. An elastic modulus of the covered fabric areas is different than the openings.

The above described features and advantages, as well as others, will become more readily apparent to those of ordinary skill in the art by reference to the following detailed description and accompanying drawings. While it would be desirable to provide an article to be worn or carried by a human that provides one or more of these or other advantageous features, the teachings disclosed herein extend to those embodiments which fall within the scope of the appended claims, regardless of whether they accomplish one or more of the above-mentioned advantages.

DETAILED DESCRIPTION

Figure 1A:
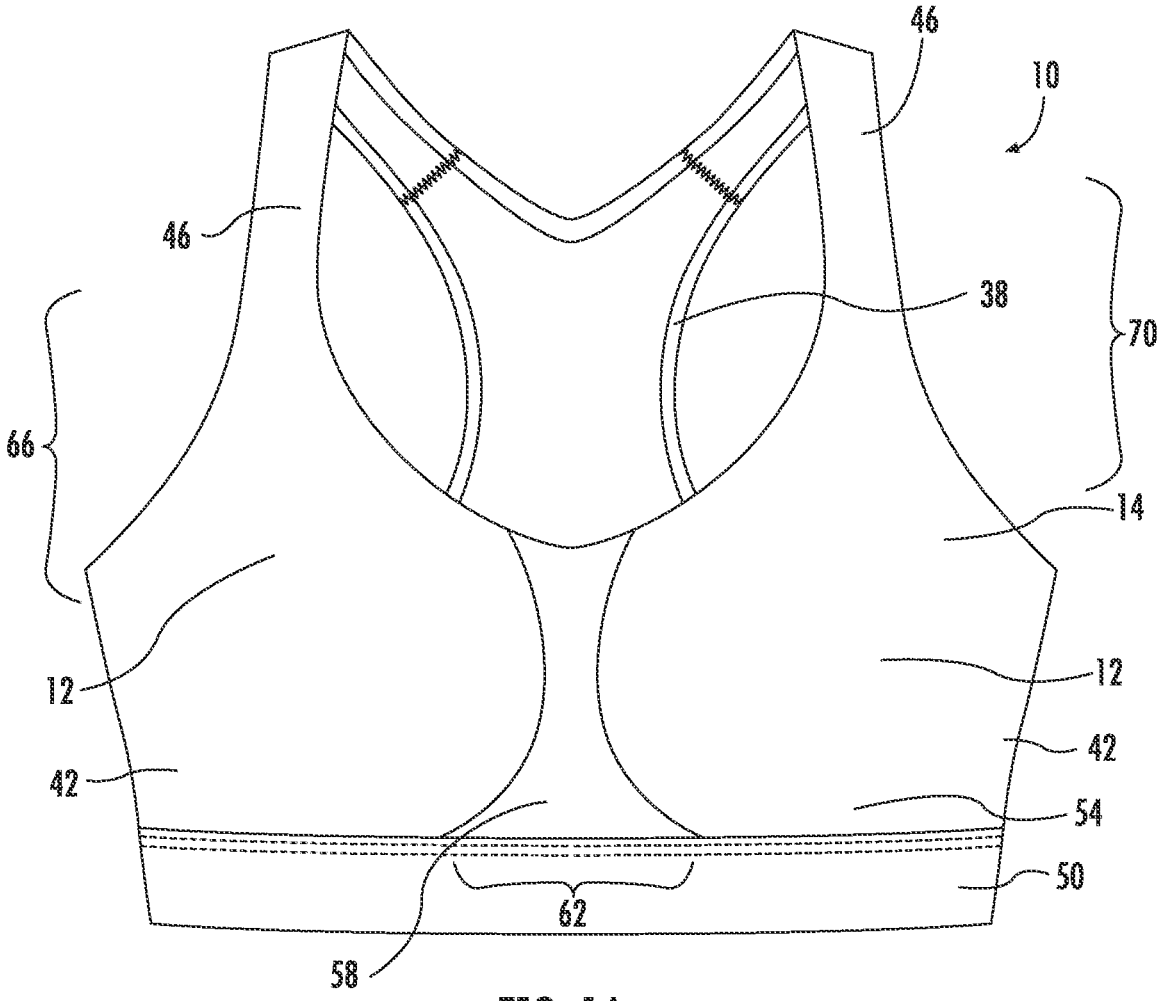
FIG. 1A shows a plan view of a front side of a bra having two cup panels.
Figure 1B:
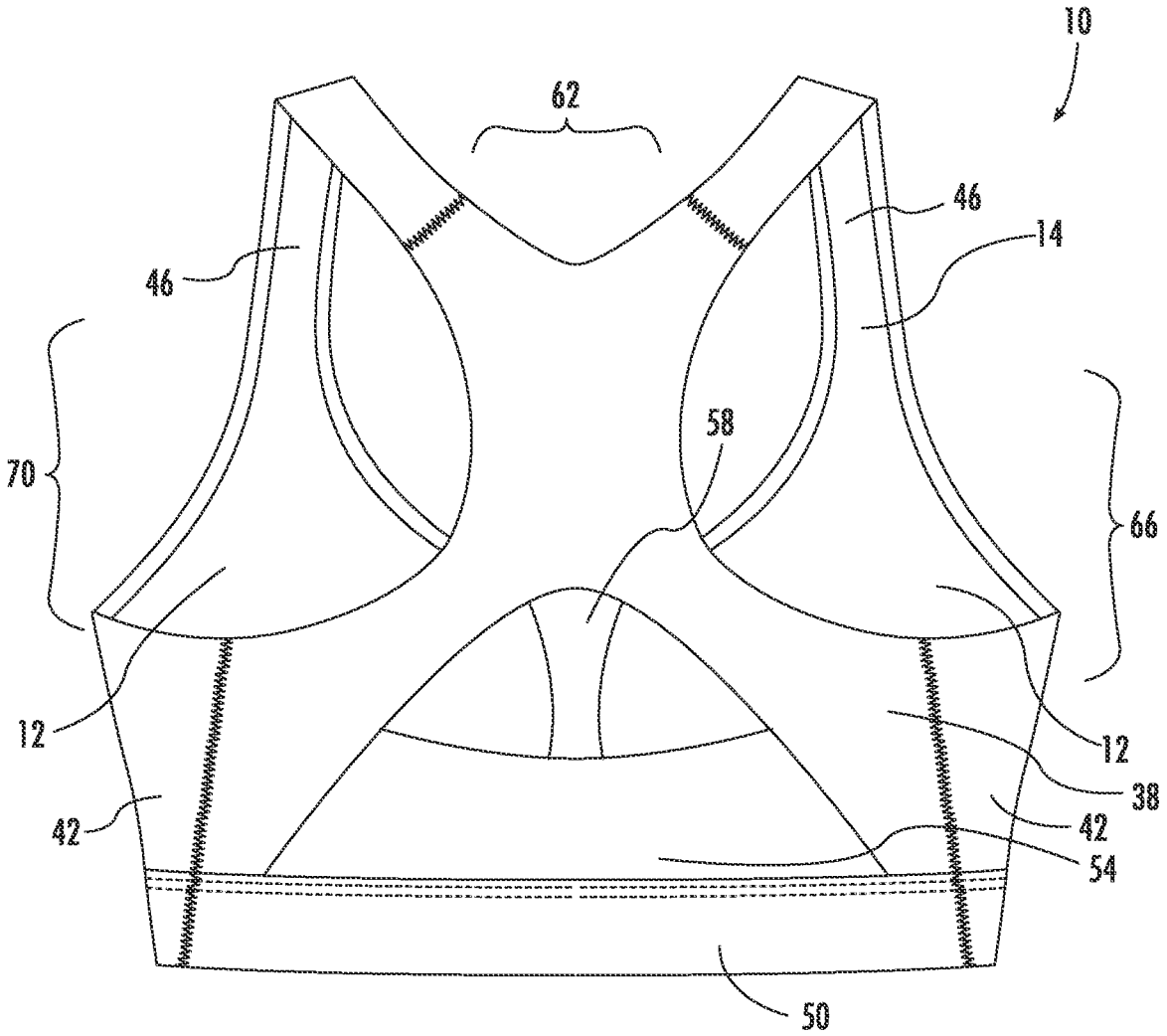
FIG. 1B shows a plan view of a back side of the bra of FIG. 1A.
Figure 2:
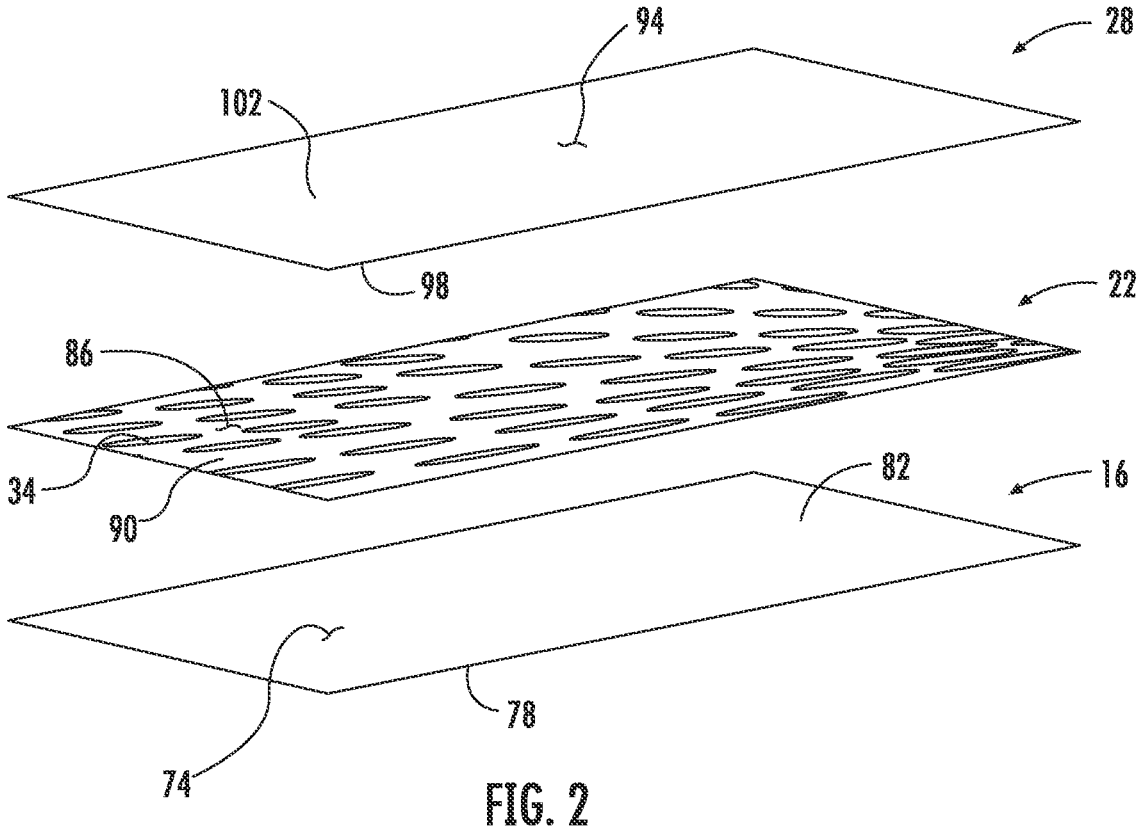
FIG. 2 shows an exploded schematic view of a portion of a cup panel of FIG. 1A including a first layer, a second layer, and a third layer.

With general reference to FIG. 1A and FIG. 1B, a brassiere or bra 10 to be worn by a female wearer is shown. The bra 10 includes two cup panels 12 provided on a front portion 14 of the bra 10 to cover and support the wearer's breasts. As shown in FIG. 2 and described in further detail below, each of the two cup panels 12 is made up of a plurality of layers 16, 22, 28 generally comprised of different materials, and one of the layers 22 defines openings 34 therein which are formed in a pattern resulting in an elasticity that varies across the layer. In alternative embodiments, the cup panels 12 can include more or fewer layers. For example, the plurality of layers 16, 22, 28 can be covered by an additional layer. As explained in further detail below, the elasticity of a layer refers to its ability to lengthen or distend under a distorting force, and then recover its original shape and size when the distorting force is removed. "Elasticity" is generally defined by two types of material parameters. The first type of material parameter is called the "elastic modulus" and measures the amount of force per unit area (stress) needed to achieve a given amount of deformation. In other words, $\lambda$=stress/strain, where $\lambda$ the elastic modulus. The greater the elastic modulus, the greater the force required to deform the material to a given extent or degree. In contrast, the lesser the elastic modulus, the lesser the force required to deform the material to a given extent or degree. The second type of parameter is called the "elastic limit" and defines a stress beyond which the material is no longer elastic or a deformation beyond which elasticity is lost. The elasticity of the layers provides specific amounts of support to the wearer's breasts. In the description below, it will be recognized that the materials used in the bra 10 have a sufficient elastic limit to withstand forces imparted to the materials during normal use of the bra. Furthermore, as explained in further detail below, different materials and different regions of such materials may be configured on the bra with differing elastic modulus, thus providing different stretch characteristics in different regions of the bra.

With reference to FIG. 1A and FIG. 1B, a front view and a back view, respectively, of the bra 10 are shown. The bra 10 includes front portion 14, a back portion 38, side areas 42, straps 46, and a bottom band 50. The front portion 14 and the back portion 38 are coupled to one another at the side areas 42 as well as at the straps 46. When the bra 10 is worn by a wearer, the back portion 38 is generally positioned over the upper portion of the back of the wearer's torso, the front portion 14 is generally positioned over the upper portion of the front of the wearer's torso, the straps 46 extend over the wearer's shoulders, and the side areas 42 are generally positioned over the upper portion of the sides of the wearer's torso. The bottom band 50 is coupled along a bottom 54 of both the front portion 14 and the back portion 38 and helps keep the bra 10 in place on the wearer's torso. The bottom band 50 is essentially comprised of an elastomer, including any of various materials commonly referred to as "elastic", as will be recognized by those of ordinary skill in the art.

The bra 10 also includes a sternum area 58 and two cup panels 12. The sternum area 58 is located substantially in a center 62 of the front portion 14 such that when the bra 10 is worn by a wearer, the sternum area 58 is generally positioned over the sternum of the wearer. The sternum area 58 also divides the front portion 14 into a left side 66 and a right side 70. The cup panels 12 are provided on the front portion 14, and one cup panel 12 is arranged on each side of the sternum area 58 such that the cup panels 12 mirror one another on the front portion 14. In other words, one cup panel 12 is provided on the left side 66 of the front portion 14 and the other cup panel 12 is provided on the right side 70 of the front portion 14. Each cup panel 12 extends from the sternum area 58 to a respective side area 42 of the bra 10 and extends from the bottom band 50 up to and along a respective strap 46. In at least one alternative embodiment, the cup panels 12 of the bra 10 can be formed together as a single piece which incorporates the sternum area 58. In such an embodiment, the cup panels 12 extend between the side areas 42 and from the bottom band 50 up and along both straps 46. In any embodiment, when the bra 10 is worn by a wearer, the cup panels 12 are generally positioned over and arranged to support the wearer's breasts.

Figure 3A:
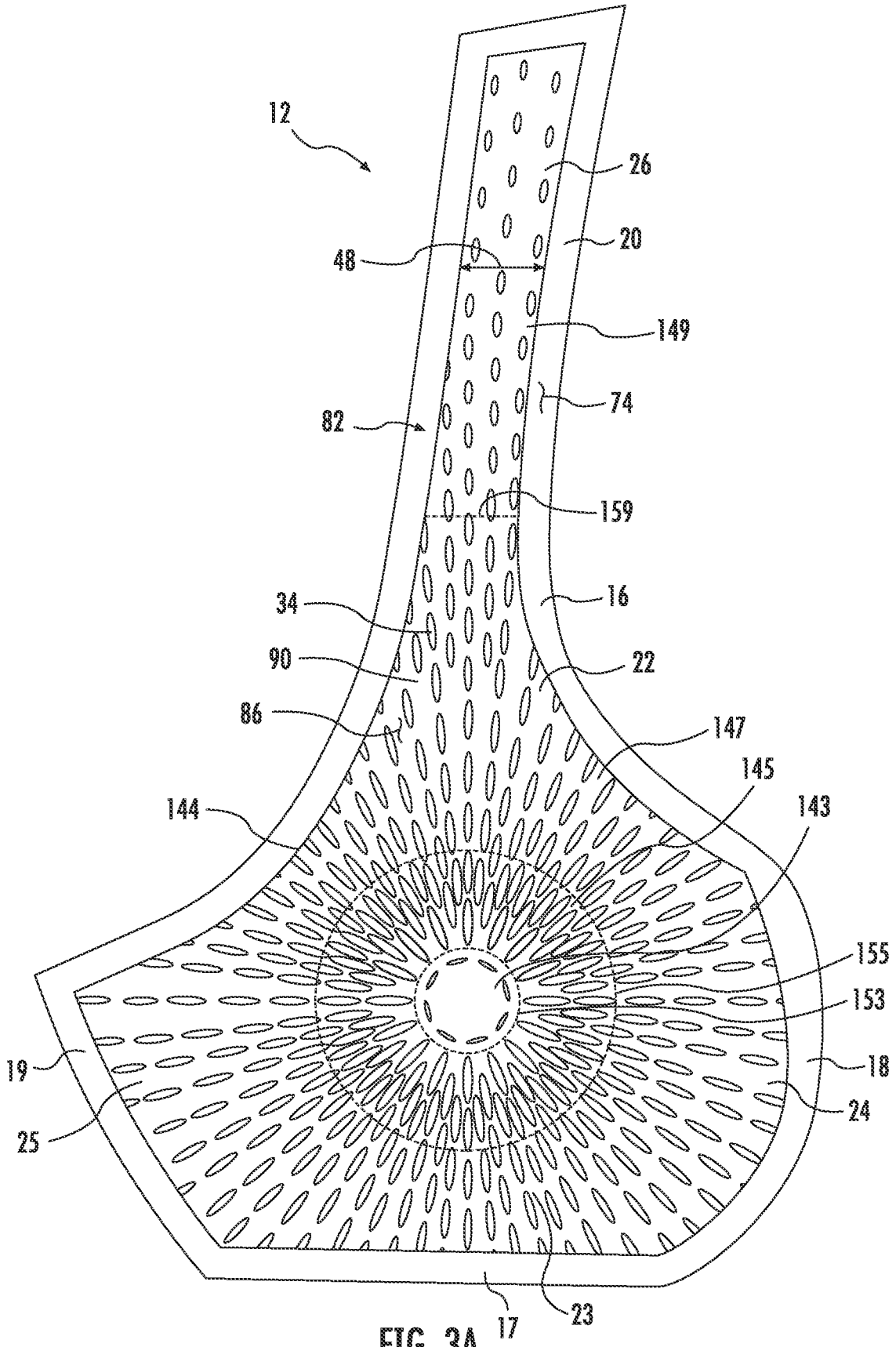
FIG. 3A shows a plan view of a front side of a portion of one of the cup panels of FIG. 1A including reference to various regions of the cup panel.

Each cup panel 12 includes three layers, including a first layer 16, a second layer 22, and a third layer 28. An exploded perspective view of a portion of the first layer 16, the second layer 22, and the third layer 28 which make up each cup panel 12 is shown in FIG. 2. The first layer 16 is a fabric layer generally comprised of a fabric material 74, and has a body facing side 78 and an opposite outward facing side 82. As shown in FIG. 3A, the first layer 16 of each cup panel 12 includes a cup portion 17, a sternum side 18, a lateral side 19, and a strap portion 20. The first layer 16 may be configured to provide an inside surface of the bra 10, an outside surface of the bra 10, or some intermediate layer between the inside and outside surfaces of the bra 10. In the embodiment shown in FIG. 1A and FIG. 1B, the first layer 16 is arranged on the inside surface of the bra 10, the sternum sides 18 are arranged at the sternum area 58 of the bra 10, the lateral sides 19 are arranged at the respective side area 42 of the bra 10, the strap portions 20 are arranged at the respective strap 46 of the bra 10, and the cup portions 17 are arranged to extend from the bottom band 50 to the sternum sides 18, the lateral sides 19, and the strap portions 20.

When the bra 10 is assembled as shown in FIG. 1A and FIG. 1B and is worn by a wearer, the body facing side 78 of the first layer 16 is in contact with the wearer's body. The first layer 16 conforms to the wearer's torso and accommodates the wearer's breasts while allowing body heat and moisture to pass through the first layer 16 and away from the wearer's body. The first layer 16 is also machine-washable and recovers its original shape when not being worn so that it able to be re-worn repeatedly. Accordingly, the fabric material 74 of the first layer 16 may be any fabric material which is breathable, flexible, has a sufficient elasticity to provide support during use of the bra 10, and is durable against machine-washing. In at least one embodiment, the fabric material 74 of the first layer 16 is a compression fabric including elastane or other elastic fibers, such as a spandex fabric. Different fabric materials may be used to provide different qualities of elasticity. For example, in one embodiment a four-way stretch fabric may be used and in another embodiment a two-way stretch fabric may be used.

Returning to FIG. 2, the second layer 22 is a polymer layer generally comprised of a polymer material 86 provided on the first layer 16. Like the first layer 16, the second layer 22 conforms to the wearer's torso, accommodates the wearer's breasts, is machine-washable, and recovers its original shape when not being worn. The second layer 22 includes a sheet of polymer material with a plurality of openings 34 formed in the polymer material. Accordingly, the second layer may be considered to include one or more unbroken and integrally formed polymer areas 90 with the openings 34 positioned between or within such polymer areas (unbroken polymer areas 90 may also be referred to herein as "solid polymer areas"). In other words, the solid polymer areas 90 are portions of the second layer 22 which provide the polymer material 86 over a continuous area. The plurality of openings 34 defined in the second layer 22 are void of the polymer material 86, and are arranged in a pattern extending over the entire second layer 22. Thus, in the embodiments disclosed herein, the second layer 22 includes a thin sheet of polymer material 86 applied to the first layer 16, the thin sheet of polymer material 86 defining one or more solid polymer areas 90 with a plurality of openings 34 formed in the sheet. Accordingly, polymer material 86 is applied to the first layer 16 at the solid polymer areas 90, but no polymer material 86 is applied to the first layer 16 at the openings 34. The openings 34 in the second layer 22 allow body heat and moisture to pass through the second layer 22 and away from the wearer's body rendering the second layer 22 breathable.

The second layer 22 is provided as a thin layer applied to the outward facing side 82 of the first layer 16 such that the second layer 22 does not contact the wearer's body. As shown in FIG. 3A, the second layer 22 of each cup panel 12 includes a cup portion 23, a sternum side 24, a lateral side 25, and a strap portion 26. Each strap portion 26 has a strap width 48. The second layer 22 also includes an outermost perimeter or perimeter edge 144. The second layer 22 is provided over substantially the entire first layer 16, and the second layer 22 of each cup panel 12 is arranged substantially similarly to the first layer 16. More specifically, when the second layer 22 is arranged within the bra 10 as shown in FIG. 1A and FIG. 1B, the sternum side 24 is arranged at the sternum area 58 of the bra 10, the lateral side 25 is arranged at a respective side area 42 of the bra 10, the strap portions 26 are arranged at the respective strap 46 of the bra 10, and the cup portions 17 are arranged to extend from the bottom band 50 to the sternum sides 24, the lateral sides 25, and the strap portions 26. The perimeter edge 144 extends around substantially an entirety of the second layer 22 and thus around substantially an entirety of the cup panel 12.

The second layer 22 may be comprised of any of various polymer materials 86. The polymer material may be applied to the first layer 16 in a thin application. As noted above, the second layer 22 includes including openings 34 where no polymer material 86 is applied. In addition, the second layer 22 is flexible, has a degree of elasticity, and is durable against machine-washing. By way of example, in at least one embodiment, the polymer material 86 of the second layer 22 is an elastomer comprised of a polyurethane resin. As another example, the polymer material 86 may be comprised of a silicon or silicone material. It will be recognized by those of ordinary skill in the art that numerous other materials may be appropriate for use as the second layer. The second layer 22 may be provided on the first layer 16 in any manner which enables a thin application including openings 34 where no polymer material 86 is applied. The second layer 22 may be provided by, for example, screen-printing, or otherwise depositing the polymer material 86 onto the first layer 16. As described in further detail below, the elastic modulus of the second layer may not be uniform and instead may vary in different regions of the second layer.

Returning to FIG. 2, the third layer 28 is a fabric layer generally comprised of a fabric material 94, and has a body facing side 98 and an opposite outward facing side 102. In substantially the same manner as described above with respect to the first layer 16, the third layer 28 of each cup panel 12 extends from the respective sternum area 58 to the respective side area 42 and extends from the bottom band 50 up to and along the respective strap 46.

To assemble the bra 10 as shown in FIG. 1A and FIG. 1B, the third layer 28 is coupled to the first layer 16 with the second layer 22 disposed between the first layer 16 and the third layer 28. In at least one embodiment, the first layer 16, second layer 22, and the third layer 28 are sewn together with the second layer 22 sandwiched in-between the first layer 16 and the third layer 28. In at least one embodiment, the first layer 16, second layer 22 and third layer 28 are non-removably coupled together such that the three layers cannot be separated without destruction of the bra 10. In at least one embodiment, the first layer 16, second layer 22 and third layer 28 are coupled together only along a perimeter portion of the cup panel 12. However, in other embodiments, the first layer 16, second layer 22 and third layer are connected over much of an entirety of the cup panel 12. Means for connecting the panels together include the use of stitching, adhesives, welding, fusing or any of various other means as will be recognized by those of ordinary skill in the art.

The third layer 28 is coupled to the first layer 16 such that the body facing side 98 of the third layer 28 contacts the second layer 22. Thus, when the bra 10 is assembled as shown in FIG. 1A and FIGS. 1B and 1*s* worn by a wearer, the outward facing side 102 of the third layer 28 faces away from the wearer's body. Like the first layer 16, the third layer 28 conforms to the wearer's torso, accommodates the wearer's breasts, allows body heat and moisture to pass through the third layer 28 and away from the wearer's body, is machine-washable, and recovers its original shape when not being worn so that it able to be re-worn repeatedly. Accordingly, the third layer 28 may be comprised of any fabric material which is breathable, flexible, has a degree of elasticity, and is durable against machine-washing. In at least one embodiment, the fabric material 94 of the third layer 28 is the same as the fabric material 74 of the first layer 16.

Returning now to FIG. 3A, the first layer 16 and the second layer 22 of one of the cup panels 12 (shown in FIG. 1A and FIG. 1B) are shown in more detail. As mentioned above, the "elastic modulus" (or "modulus of elasticity") of a material (or associated panel comprised of the material) refers to the extent to which a material (or the associated panel) lengthens or distends under a given distorting force. The "elastic limit" refers to a force after which the material (or associated panel) is unable to recover its original shape and size. In the case of the bra 10 disclosed herein, the distorting force is the force applied to the bra 10 by breasts during physical exercise. The materials used to make the bra generally have an elastic limit that is sufficient to withstand repeated normal use of the bra during physical exercise. Elasticity, including the elastic modulus and elastic limit is an inherent physical property of each material used to make the bra 10. Over time, elasticity of a material can be affected by additional factors such as exposure of the material to temperatures and ultraviolet light.

The fabric material 74 of the first layer 16 has a particular elastic modulus, which enables the fabric material 74 to lengthen or distend a specific amount when the force is applied. The elasticity of the first layer 16 over a given area and in a given direction may depend on the orientation of the fabric material 74 on the garment and whether the fabric material 74 is a two-way stretch material or a four way stretch material. For example, if the fabric material 74 is a two way stretch material, a vertical orientation of the two way stretch direction on the garment will offer different support than a horizontal orientation of the two way stretch direction on the garment.

Likewise, the polymer material 86 of the second layer 22 has a particular elasticity, which enables the polymer material 86 to lengthen or distend a specific amount when a force is applied to the polymer material 86, and a particular elasticity, which enables the polymer material 86 to recover a specific amount when the force is removed. The elasticity of the second layer 22 over a given area and in a given direction depends on several factors including, (i) the elastic qualities of the polymer material used to form the second layer 22, (ii) the thickness of the second layer 22, (iii) the number and size of openings 34 defined in the second layer 22 (i.e., the density of the openings in the second layer), and (iv) the orientation of the openings 34. In general, an opening 34 defined in the second layer 22 decreases the elastic modulus of the polymer material 86 of the second layer 22. The greater the number of openings 34 in a given area, the lesser the elastic modulus in that area. Similarly, the larger each opening 34 is in a given area, the lesser the elastic modulus of the second layer in that area. The shape of the openings 34 may also affect the directional stretch of the second layer 22. For example, if the openings 34 have an elliptical or oblong shape, the elastic modulus of the second layer 22 may be greater in the direction of the greatest diameter across the shape of the opening, as discussed in further detail below.

Taken alone, the first layer 16 has a first elasticity (i.e., that of the sheet fabric material 74) and the second layer 22 has a second elasticity (i.e., that of the sheet of polymer material 86). However, because the second layer 22 is provided on the first layer 16, the first layer 16 and the second layer 22 have a combined elasticity that is different from that of either the first layer 16 or the second layer 22 when taken alone. Because the fabric material 74 of the first layer 16 has a lesser elastic modulus than the polymer material 86 of the second layer 22, the second layer 22 has a more limiting influence on the elastic modulus of the combined layers. In particular, in those areas outside of the openings 34 where the polymer material 86 is applied to the fabric material 74, the combined elastic modulus of the first layer 16 and the second layer 22 over a given area is limited by the elastic modulus of the second layer 22. However, at the location of the openings 34, the combined elastic modulus of the first layer 16 and the second layer 22 is not limited by the second layer 22 since the polymer material 86 is not applied to the fabric material 74 at the openings.

Additionally, as noted above, the polymer material 86 of the second layer 22 has a greater elastic modulus than the fabric material 74 of the first layer 16. Therefore, the greatest influence on the degree of stretch of the first layer 16 and the second layer 22 in combination is provided by the second layer 22. The combined elastic modulus of the first layer 16 and the second layer 22 is greater at those locations outside of the openings 34 where the polymer material 86 is applied to the fabric material 74.

As discussed above, the elastic modulus of the combined first layer 16 and the second layer 22 over a given area and in a given direction depend on the elastic modulus of both the first layer 16 and the second layer 22. It will be recognized that this elastic modulus of the combined first layer 16 and second layer 22 depends in part on the number and size of openings 34 defined in the second layer 22 (i.e., the density of the openings in the second layer) as well as the orientation of the openings 34. In general, the polymer material 86 increases the elastic modulus of the combined first layer 16 and the second layer 22, while an opening 34 defined in the second layer 22 decreases the elastic modulus of the combined first layer 16 and second layer 22 over a given area. Because an opening 34 in the second layer 22 is void of the polymer material 86, the larger the opening 34 in the second layer 22, the greater the amount of fabric material 74 from the first layer 16 that is exposed in that area. Similarly, the greater the number of openings 34 in a given area, the greater the amount of fabric material 74 that is exposed in that area. Because the fabric material 74 of the first layer 16 has a smaller elastic modulus than the polymer material 86 of the second layer 22, the more fabric material 74 that is exposed in an area, the smaller the combined elastic modulus of that area. In other words, the higher the percentage of fabric material 74 that is exposed in that given area (i.e., the higher the density of openings 34 in a given area), the smaller the combined elastic modulus of that area. Similarly, the lower the density of openings 34 in a given area, the greater the elastic modulus of that area.

Based on the above, it will be recognized that the elastic modulus of a cup panel 12 of the bra 10 may be varied across different regions of the cup panel 12 by varying the density of openings in the second layer 22. FIG. 3A shows an exemplary embodiment of an arrangement for the cup panel 12 wherein the openings 34 in the second layer 22 are distributed across various regions of the cup panel 12, including a nipple region 143, a central cup region 145, a perimeter cup region 147, and a strap region 149.

In FIG. 3A, the nipple region 143 is a portion of the cup panel 12 covering the nipple of a wearer of the bra 10, and is defined by the region within dotted line 153. The central cup region 145 is an area outside of the nipple region 143, but not extending to the perimeter of the cup panel 12. The central cup region 145 is thus associated with an area on the breast of a wearer which is significantly rounded as the surface of breast curves moving outward from the nipple. The central cup region 145 is defined in FIG. 3A between dotted lines 155 and 153, and surrounds the nipple region 143. In the embodiment of FIG. 3A, the nipple region 143 and the central cup region 145 are both circular areas.

The perimeter cup region 147 is an area that extends along the perimeter of the cup panel 12 and surrounds the central cup region 145 without extending into the strap portion 26. Thus, the perimeter cup region 147 has an outline that matches the outline shape of the second layer 22 except for the strap portion. In FIG. 3A the perimeter cup region 147 extends outward from dotted lines 155 to the perimeter edge 144 of the second layer 22 and to the dotted line 159 which indicates the transition to the strap region 149. The strap region 149 extends outward from the perimeter cup region along the strap portion 26 of the second layer 22. Thus, the strap region 149 extends into one of the straps 46 of the bra 10 and is similarly shaped as the strap.

With continued reference to FIG. 3, the density of the openings 34 in the second layer 22 of the cup panel 12 varies moving radially outward from the nipple region 143. As such the elastic modulus of the cup panel 12 also varies moving radially outward from the nipple region 143. The nipple region 143 is predominantly a solid polymer area 90 with a few small openings 34 along the perimeter of the nipple region. Accordingly, the density of openings in the nipple region 143 is relatively low, and the elastic modulus in the nipple region is relatively high. This has the benefit of providing substantial support to the wearer in the nipple region of the cup panel 12 and providing an additional level of modesty for the wearer.

The greatest density of openings 34 in the second layer 22 of the cup panel 12 is found in the central cup region 145. Accordingly, the elastic modulus of in the central cup region 145 is significantly lower than in the nipple region 143. Because the central cup region 145 is associated with an area on the breast of the wearer which is significantly curved, the lower elastic modulus in the central cup region 145 provides the benefit of the cup panel more easily stretching to conform to the curves of the breast in this region. This allows the cup panel 12 to provide a closer fit in the central cup region 145 while still offering adequate support for the breast in this region.

The density of openings 34 in the perimeter cup region 147 is even lower than in the central cup region 145. Accordingly, the elastic modulus of in the central cup region 145 is significantly lower than in the nipple region 143. It will be noted that in the embodiment of FIG. 3A, this lower density of openings 34 is a result of the arrangement of the openings 34 on the panel as well as the size of the openings 34. In particular, the openings are arranged along ray lines that extend radially outward from the nipple region 143. Because the ray lines diverge as they extend further away from the nipple region 143, the openings 34 on the ray lines are naturally spaced further and further apart moving away from the nipple region 143. Additionally, in the embodiment of FIG. 3A, the size of the openings becomes increasingly smaller moving away from the nipple region 143. Thus, the openings 34 positioned in the perimeter cup region 147 are smaller than the openings 34 in the central cup region 145. Additionally, the openings in the strap region 149 are smaller than the openings in the perimeter cup region 147. As a result, the density of openings 34 in the perimeter cup region 147 is less than the density of openings in the central cup region 145, and the density of openings 34 in the strap region 149 is less than the density of openings in the perimeter cup region 147. Therefore, the elastic modulus of the perimeter cup region 147 is greater than the elastic modulus of the central cup region 145, and the elastic modulus of the strap region 149 is greater than the elastic modulus of the perimeter cup region 147.

The foregoing arrangement of the cup panel 12 of FIG. 3A has the benefit of providing a bra panel with the greatest elastic modulus and most resistance to stretch in areas where it is most desirable (e.g., the strap region 149) and a slightly decreased elastic modulus and lesser resistance to stretch in different areas where it is most desirable (e.g., the central cup region 145). Similarly, the arrangement of FIG. 3A has the advantage of providing a cup panel 12 with an elastic modulus gradient that steadily increases moving radially outward from a nipple region, thus providing a cup panel with a unique elastic modulus that conforms to the breast of the wearer while providing changing levels of stretch and support that are targeted to specific areas of the breast.

Although a two layer arrangement for the cup panel 12 has been described above including openings 34 in the second layer 22 to control the elastic modulus in various regions of the cup panel 12, it will be recognized that alternative arrangements may be used to control of the elastic modulus in various regions of the cup panel. An example of such an alternative arrangement is a single layer cup panel comprised of an engineered fabric, wherein the elastic modulus provided by the fabric is different in different regions of the cup panel. Thus, a two layer structure is not required to incorporate the concept described herein of varying elastic modulus in different regions of the cup panel 12.

As noted above, the size and density of the openings 34 may be varied to control the elastic modulus in different regions of the cup panel 12. In addition, it will be noted that the actual shape and orientation of the openings 34 of the second layer 22 may also have an effect the combined elastic modulus of the first layer 16 and the second layer 22 over a given area. This is especially true when the openings 34 are non-circular. When the openings 34 are non-circular, the second layer 22 tends to provide more stretchability (i.e., a lower elastic modulus) in the direction of the smallest diameter of the opening. In particular, the smallest diameter of an the opening 34 allows for the "mouth" of the opening 34 to enlarge or "open" in the direction of the applied force to a greater degree than is possible in the opposite larger diameter direction. In particular, as a force is applied to the second layer 22 in a direction that causes the mouth of the opening 34 to enlarge across its smallest diameter, the polymer material 86 around the mouth tends to buckle slightly as the opposing sides of the mouth are moved toward one another (i.e., in the direction opposite the direction of the applied force). This buckling of the second layer 22 allows the mouth of the opening to enlarge significantly as the polymer material 86 only stretches slightly. The buckling will continue until the opposing sides of the mouth (i.e., the sides opposing each other in a direction perpendicular to the direction of stretch) are brought relatively close together. When a force is applied to the opening 34 in an opposite direction that causes the mouth of the opening 34 to enlarge across its larger diameter, a similar buckling also occurs. However, in this situation, the opposing sides of the opening 34 (i.e., the sides defining the smallest diameter of the opening) traverse a smaller distance before the polymer material begins to stretch to a substantial degree. Accordingly, the shape and arrangement of the openings 34 on the second layer 22 impacts the combined stretchability because the first layer 16 and the second layer 22 will stretch more readily (i.e., has a lower modulus of elasticity) in a direction of the smallest dimension of an opening 34. This will be illustrated in further detail below with reference to FIG. 4.

Figure 4:
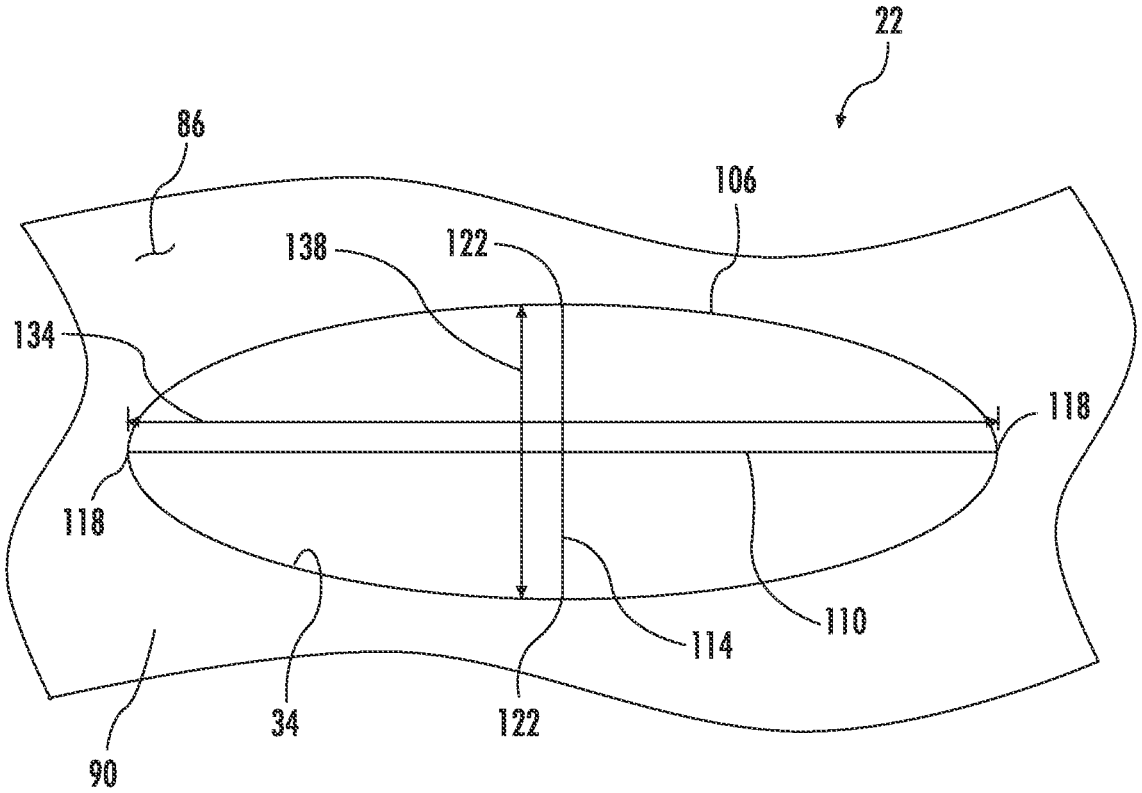
FIG. 4 shows a schematic view of an opening of the second layer of FIG. 2

Turning now to FIG. 4, a schematic view of a single opening 34 is shown to facilitate description of an exemplary embodiment of the shape of the openings 34 in the second layer 22. As shown, the opening 34 defined in the second layer 22 has an oval shape with a perimeter 106, a major axis 110, and a minor axis 114. The major axis 110 is defined between two major vertices 118 which are on opposite sides of the perimeter 106 at the largest span (i.e., diameter) of the opening 34. The minor axis 114 is defined between two minor vertices 122 which are on opposite sides of the perimeter 106 at the smallest span (i.e., diameter) of the opening 34. Accordingly, a major axis length 134, which is coextensive with the largest span of the opening 34, is larger than a minor axis length 138, which is coextensive with the smallest span of the opening 34, when the second layer 22 is laid flat.

With continued reference to FIG. 4, the opening 34 provides the greatest stretchability (i.e., the lowest elastic modulus) to the second layer 22 in a direction along the minor axis 114. The reason for this is related to the degree of stretch the configuration of the opening 34 provides in a given direction without substantial stretching of the polymer material 86 itself. In the example of FIG. 4, when a force is applied to in the direction of the minor axis 114 the force initially pulls the opposing minor vertices 122 away from each other. As the opposing minor vertices 122 are pulled away from each other, the polymer material 86 around the opening 34 begins to buckle as the opposing major vertices 118 are drawn toward each other. During this time, relatively little resistance to stretch is provided by the second layer 22 in the area of the opening 34, and the substantial resistance to stretch is provided by the fabric of the first layer 16 inside the opening 34. As the mouth of the opening 34 continues to deform, the opposing major vertices 118 reach a threshold position where they will not come substantially closer to one another. In order for additional stretch to occur at this point, the polymer material 86 itself must be stretched significantly in the direction of the force along the minor axis 114 (as opposed to continued opening deformation). Similar deformation of the second layer 22 occurs when a force is applied in the direction of the major axis 110, pulling the major vertices 118 away from each other. However, as the major vertices 118 are pulled away from each other and the polymer material buckles around the opening 34, the opposing minor vertices 122 are already relatively close to one another. Accordingly, when the opposing minor vertices 122 are drawn together a relatively short distance, the threshold position is reached and the polymer material 86 must be significantly stretched in order for additional stretching to occur. Thus, in the example of FIG. 4, because the mouth of the opening 34 can be elongated to a greater degree in the direction of the minor axis 114 than in the direction of the major axis 110 before substantial stretching of the polymer material 86 is required (i.e., because the distance between the major vertices 118 is greater than the distance between the minor vertices 122) the shape of the opening 34 provides for a greater degree of stretch along the minor axis 114 than along the major axis 110.

As set forth above, it will be recognized that the shape of the openings has some effect on the elastic modulus of the combined first layer 16 and second layer 22. While the opening 34 in the example provided herein are in the shape of an ellipse, it will be understood that various other shapes and various sized openings are possible. For example, each opening 34 may be substantially shaped as a rhombus or another geometric shape having a major axis and a minor axis. In other embodiments, the openings 34 can have different shapes throughout the second layer 22 as long as each shape has a major axis and a minor axis. In various other embodiments, the shapes may be regular polygons or irregular polygons which may or may not include a well-defined major and minor axis.

As set forth in the preceding paragraphs, it will be appreciated that the shape of the openings 34 has some effect on the elastic modulus of the combined first layer 16 and second layer 22. However, it will also be recognized that the elastic modulus of the combined first layer 16 and second layer 22 is also dependent upon several other factors as discussed above, including the type of fabric for the first layer 16, the type of polymer material for the second layer 22, and the orientation of the openings in the second layer 22 relative to the direction of stretch of the fabric of the first layer 16.

Furthermore, in addition to the affect the openings 34 have on the elastic modulus of the cup panel 12, it will also be recognized that the number and size of openings 34 defined in the second layer impacts the breathability of the combined first layer 16 and second layer 22, and thus the breathability of the bra 10. Because the fabric material 74 of the first layer 16 has a greater breathability than the polymer material 86 of the second layer 22, the more fabric material 74 that is exposed in an area, the greater the breathability of that area. In other words, the higher the density of openings 34 in a given area, the higher the percentage of fabric material 74 that is exposed in that given area, and the greater the breathability of the bra 10 in that area.

To this point, the size, density, and orientation, of the openings 34 defined in the second layer 22 has been discussed along with the effect on the elastic modulus and breathability of the first layer 16 and the second layer 22. Now, exemplary arrangements of such openings on the second layer 22 will be discussed. As will be discussed below, the arrangement of the openings may be varied to provide targeted support on the garment, including targeted support for the wearer's breasts during physical exercise.

Figure 3B:
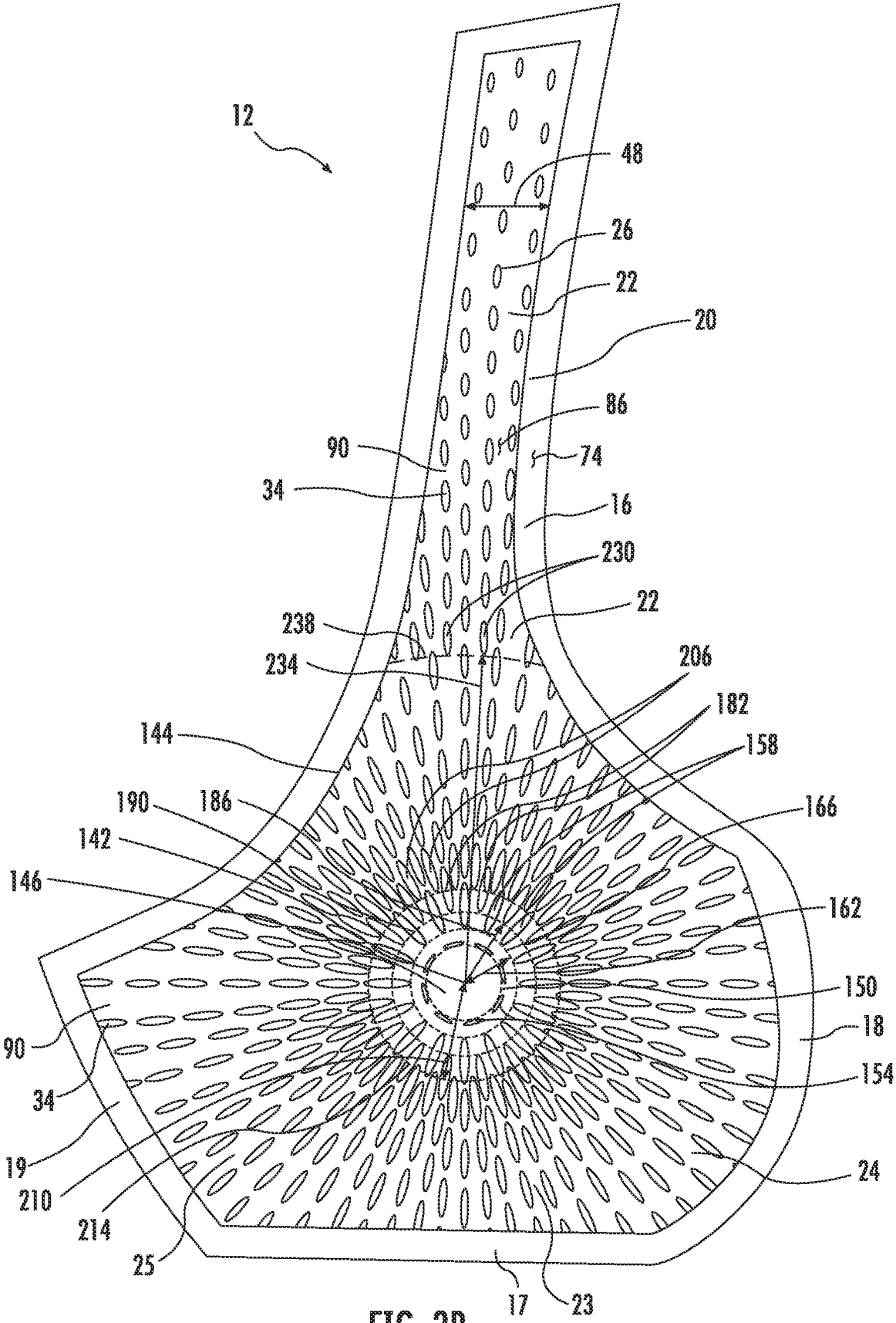
FIG. 3B shows another plan view of a front side of a portion of one of the cup panels of FIG. 1A including reference to various concentric circles around a central polymer area of the cup panel.

With reference now to FIG. 3B, the openings 34 defined in the second layer 22 are arranged and oriented in a pattern that extends across substantially an entirety of the second layer 22. The pattern of openings 34 is arranged about a center point or apex 142 and extends to the outermost edge 144 of the second layer 22. As shown, the apex 142 is located in a central polymer area 146 of the second layer 22 which is comprised of a solid polymer area 90 shaped substantially as a circle having an outer perimeter 150 (shown as a dashed line in FIG. 3B). Because the central polymer area 146 comprises a solid polymer area 90, the apex 142 is located in an area having lower stretchability (i.e., a greater elastic modulus). In other words, the apex 142 is located in an area which provides a maximum amount of support during physical exercise. In the present embodiment, the apex 142 is positioned in the cup portion 23 of the second layer 22 in a location that is associated with a nipple of the wearer (e.g., the apex 142 and the central polymer area 146 are in an area corresponding to the nipple region 143 of FIG. 3A). As shown in FIG. 3A, the polymer layer (i.e., the second layer 22) in the central polymer area 146 is void of any openings 34 and therefore provides a continuous region of the polymer layer. The areas outside of the central polymer area 146 all include openings 34 and therefore provide discontinuous regions of the polymer layer.

The apex 142 serves as a point of origin from which the pattern of openings 34 extends as a substantially radial pattern. As used herein, a radial pattern is one which appears to radiate from a point, like the spokes from the hub of a wheel. Accordingly, as used herein, features which radiate from a point are arranged like radii or rays extending from the point outwardly. To describe the pattern of openings 34 more clearly, the openings 34 are grouped together based on shared features and shared dimensions relative to the apex 142. The openings 34 are arranged about the apex 142 in a radial pattern that can be described both in terms of radial line segments emanating from the apex 142 and in terms of concentric circles centered about the apex 142. The pattern of openings 34 extends to the outermost edge 144 and those openings 34 which are arranged at or on the outermost edge 144 are truncated where the second layer 22 ends.

With continued reference to FIG. 3B, a first group of openings 34 defined in the second layer 22 are referred to as central openings 154 and are arranged along the outer perimeter 150 of the central polymer area 146 such that a minor vertex 122 (shown in FIG. 4) of each central opening 154 is positioned nearest to the apex 142. Accordingly, the central openings 154 enable a limited amount of stretch radially outwardly from the apex 142 via the minor axes 114 (shown in FIG. 4) and a slightly smaller amount of stretch concentrically around the apex 142 via the major axes 110 (shown in FIG. 4). The central openings 154 are spaced substantially evenly along the outer perimeter 150 of the central polymer area 146 to form a circle centered about the apex 142, and the central openings 154 all have substantially the same major axis length 134 (shown in FIG. 4) and substantially the same minor axis length 138 (shown in FIG. 4) such that the central openings 154 are all substantially the same shape and size. Accordingly, the central openings 154 enable an equal amount of stretch around the apex 142. A solid polymer area 90 is located between each central opening 154 such that the central openings 154 do not contact one another to limit the amount of stretch of the central openings 154. In the embodiment shown, there are eight central openings 154, but other embodiments can include more or fewer than eight central openings 154.

A second group of openings 34 defined in the second layer 22 are referred to as innermost radial openings 158 and are arranged farther from the apex 142 than the central openings 154. A solid polymer area 90 is located between the central openings 154 and the innermost radial openings 158 to provide an area of greater support surrounding the central openings 154. Each innermost radial opening 158 is arranged such that a major vertex 118 (shown in FIG. 4) is positioned nearest to the apex 142. Accordingly, the innermost radial openings 158 facilitate a greatest amount of stretch concentrically around the apex 142 via the minor axes 114 (shown in FIG. 4) and facilitate a slightly smaller amount of stretch radially from the apex 142 via the major axes 110 (shown in FIG. 4).

The major vertex 118 of each innermost radial opening 158 that is nearest to the apex 142 is spaced an innermost distance 162 from the apex 142 such that the innermost radial openings 158 are arranged to form an innermost concentric circle 166 (shown with a dashed line in FIG. 3B) centered about the apex 142 and spaced the innermost distance 162 from the apex 142. The innermost radial openings 158 are spaced substantially evenly along the innermost concentric circle 166, and the innermost radial openings 158 all have substantially the same major axis length 134 (shown in FIG. 4) and substantially the same minor axis length 138 (shown in FIG. 4) such that the innermost radial openings 158 are all substantially the same shape and size. Accordingly, the innermost radial openings 158 enable an equal amount of stretch around the apex 142. A solid polymer area 90 is located between each innermost radial opening 158 such that the innermost radial openings 158 do not contact one another to limit the amount of stretch of the innermost radial openings 158. In the embodiment shown, there are sixteen innermost radial openings 158, but other embodiments can include more or fewer than sixteen innermost radial openings 158.

A third group of openings 34 defined in the second layer 22 are referred to as intermediary radial openings 182 and are arranged farther from the apex 142 than the innermost radial openings 158. The intermediary radial openings 182 are interposed between the innermost radial openings 158, and a solid polymer area 90 is located between each innermost radial opening 158 and the adjacent intermediary radial openings 182 to provide support between the openings 34. Each intermediary radial opening 182 is arranged such that a major vertex 118 (shown in FIG. 4) is positioned nearest to the apex 142, and the major vertex 118 of each intermediary radial opening 182 that is nearest to the apex 142 is spaced an intermediary distance 186 from the apex 142. The intermediary distance 186 is greater than the innermost distance 162. Accordingly, the intermediary radial openings 182 facilitate a greatest amount of stretch concentrically around the apex 142 via the minor axes 114 (shown in FIG. 4) and facilitate a slightly smaller amount of stretch radially from the apex 142 via the major axes 110 (shown in FIG. 4).

The intermediary radial openings 182 form an intermediary concentric circle 190 centered about the apex 142 and spaced the intermediary distance 186 from the apex 142. The intermediary radial openings 182 are spaced substantially evenly along the intermediary concentric circle 190, and the intermediary radial openings 182 all have substantially the same major axis length 134 (shown in FIG. 4) and substantially the same minor axis length 138 (shown in FIG. 4) such that the intermediary radial openings 182 are all substantially the same shape and size. Accordingly, the intermediary radial openings 182 enable an equal amount of stretch around the apex 142. A solid polymer area 90 is located between each intermediary radial opening 182 such that the intermediary radial openings 182 do not contact one another to limit the amount of stretch of the intermediary radial openings 182. In the embodiment shown, there are sixteen intermediary radial openings 182, but other embodiments can include more or fewer than sixteen intermediary radial openings 182.

A fourth group of openings 34 defined in the second layer 22 are referred to as outermost radial openings 206 and are arranged farther from the apex 142 than the intermediary radial openings 182. The outermost radial openings 206 are interposed between the innermost radial openings 158 and the intermediary radial openings 182, and a solid polymer area 90 is located between each outermost radial opening 206 and the adjacent innermost radial openings 158 and intermediary radial openings 182 to provide support between the openings 34. Each outermost radial opening 206 is arranged such that a major vertex 118 (shown in FIG. 4) is positioned nearest to the apex 142, and the major vertex 118 of each outermost radial opening 206 that is nearest to the apex 142 is spaced an outermost distance 210 from the apex 142. The outermost distance 210 is greater than the intermediary distance 186. Accordingly, the outermost radial openings 206 facilitate a greatest amount of stretch concentrically around the apex 142 via the minor axes 114 (shown in FIG. 4) and facilitate a slightly smaller amount of stretch radially from the apex 142 via the major axes 110 (shown in FIG. 4).

The outermost radial openings 206 form an outermost concentric circle 214 centered about the apex 142 and spaced the outermost distance 210 from the apex 142. The outermost radial openings 206 are spaced substantially evenly along the outermost concentric circle 214, and the outermost radial openings 206 all have substantially the same major axis length 134 (shown in FIG. 4) and substantially the same minor axis length 138 (shown in FIG. 4) such that the outermost radial openings 206 are all substantially the same shape and size. Accordingly, the outermost radial openings 206 enable an equal amount of stretch around the apex 142. A solid polymer area 90 is located between each outermost radial opening 206 such that the outermost radial openings 206 do not contact one another to limit the amount of stretch of the outermost radial openings 206. In the embodiment shown, there are thirty-two outermost radial openings 206, but other embodiments can include more or fewer than thirty-two outermost radial openings 206.

A fifth group of openings 34 defined in the second layer 22 are referred to as strap portion openings 230 and are defined only in the strap portion 26 of the second layer 22. Each strap portion opening 230 is arranged such that a major vertex 118 (shown in FIG. 4) is positioned nearest to the apex 142 to facilitate a greatest amount of stretch across the strap width 48 via the minor axes 114 (shown in FIG. 4) and a slightly smaller amount of stretch radially relative to the apex 142 along the strap portion 26 of the second layer 22 via the major axes 110 (shown in FIG. 4). In one embodiment the major vertex 118 of each strap portion opening 230 that is nearest to the apex 142 is spaced a strap portion distance 234 from the apex 142 such that the strap portion openings 230 form a strap portion arc 238 centered about the apex 142 and spaced the strap portion distance 234 from the apex 142. This arrangement enables stretch equally across the strap width 48. In another embodiment, the major vertices 118 that are nearest to the apex 142 are spaced at varying distances from the apex 142 such that the strap portion openings 230 do not form an arc. This arrangement enables unequal stretch across the strap width 48.

A solid polymer area 90 is located between each strap portion opening 230 such that the strap portion openings 230 do not contact one another to limit the amount of stretch of the strap portion openings 230. The strap portion openings 230 all have substantially the same major axis length 134 (shown in FIG. 4) and substantially the same minor axis length 138 (shown in FIG. 4) such that the strap portion openings 230 are all substantially the same shape and size. In the embodiment shown, there are three strap portion openings 230, but other embodiments can include more or fewer than three strap portion openings 230. In at least one embodiment, the number of strap portion openings 230 is dependent on the strap width 48 (shown in FIG. 3B) such that a strap portion 26 having a wider strap width 48 has a larger number of strap portion openings 230 defined therein than a strap portion 26 having a narrower strap width 48.

Figure 5:
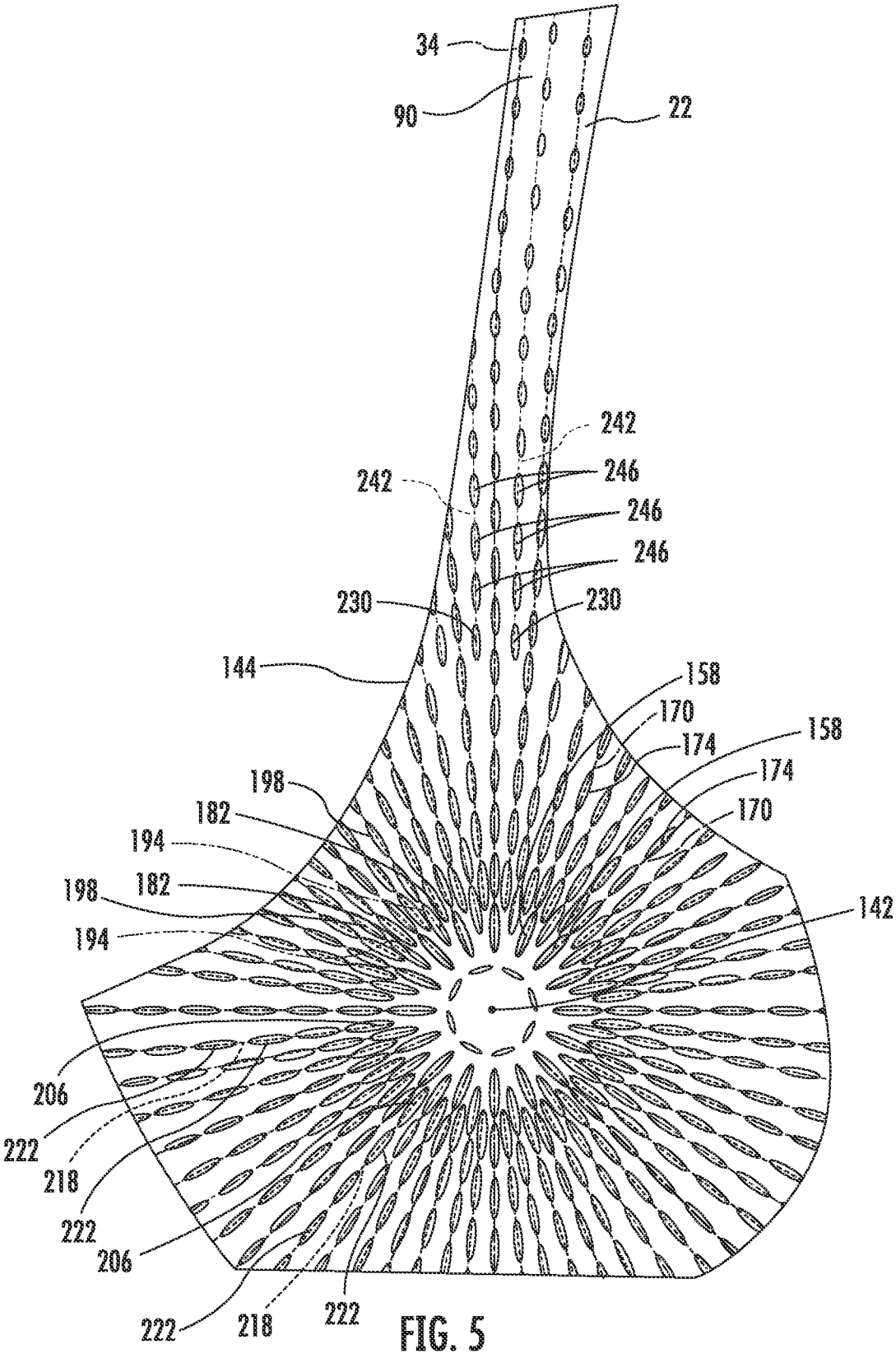
FIG. 5 shows a plan view of a front side of the second layer of FIG. 2 including a plurality of radiating line segments.

Turning now to FIG. 5, the pattern of openings 34 defined in the second layer 22 may be considered as being arranged such that a plurality of radially adjacent openings 34 are aligned along various rays or radially extending line segments which extend in a substantially radial direction outwardly from the apex 142. These radial line segments include innermost radial line segments 170, intermediary radial line segments 194, outermost radial line segments 218, and strap portion line segments 242 superimposed thereon. Each line segment 170, 194, 218, and 242 extends to the outermost edge 144 of the second layer 22 such that the line segments 170, 194, 218, 242 are arranged in a radial pattern about the apex 142. In the embodiment of FIG. 5, at least three openings 34 are provided along each of the line segments, and as many as eighteen openings 34 are provided along one line segment.

Each innermost radial line segment 170 passes through the major vertices 118 (shown in FIG. 4) of an innermost radial opening 158 and extends to the outermost edge 144 of the second layer 22 such that the innermost radial line segments 170 are arranged in an aligned radial pattern about the apex 142. Like the innermost radial openings 158, there are sixteen innermost radial line segments 170 spaced substantially evenly around the innermost concentric circle 166 (shown in FIG. 3B), and each innermost radial opening 158 is arranged on an innermost radial line segment 170.

In an analogous manner to the innermost radial line segments 170 described above, each intermediary radial line segment 194 passes through the major vertices 118 (shown in FIG. 4) of an intermediary radial opening 182 and extends to the outermost edge 144 of the second layer 22 such that the intermediary radial line segments 182 are arranged in a radial pattern about the apex 142. There are sixteen intermediary radial line segments 194 spaced substantially evenly around the intermediary concentric circle 190 (shown in FIG. 3B), and each intermediary radial opening 182 is arranged on an intermediary radial line segment 194.

In an analogous manner to the innermost radial line segments 170 described above, each outermost radial line segment 218 passes through the major vertices 118 (shown in FIG. 4) of an outermost radial opening 206 and extends to the outermost edge 144 of the second layer 22 such that the outermost radial line segments 218 are arranged in a radial pattern about the apex 142. The same number of outermost radial line segments 218 as outermost radial openings 206 are spaced substantially evenly around the outermost concentric circle 214 (shown in FIG. 3B), and each outermost radial opening 206 is arranged on an outermost radial line segment 218.

In an analogous manner to the innermost radial line segments 170 described above, each strap portion line segment 242 passes through the major vertices 118 (shown in FIG. 4) of a strap portion opening 230 and extends to the outermost edge 144 of the second layer 22 such that the strap portion line segments 242 are arranged in a radial pattern about the apex 142. The same number of strap portion line segments 242 as strap portion openings 230 are spaced substantially evenly along the strap width 48 (shown in FIG. 3B), and each strap portion opening 230 is arranged on a strap portion line segment 242. In the embodiment in which the strap portion openings 230 are arranged on a strap portion arc 238 (shown in FIG. 3B), the strap portion line segments 242 are spaced substantially evenly along the strap portion arc 238 (shown in FIG. 3B), and each strap portion opening 230 is arranged on a strap portion line segment 242.

With continued reference to FIG. 5, in addition to passing through an innermost radial opening 158, each innermost radial line segment 170 passes through a number of innermost origin openings 174 aligned with each of the innermost radial openings 158. The innermost origin openings 174 are arranged along the innermost radial line segments 170 such that the innermost radial line segments 170 pass through the major vertices 118 (shown in FIG. 4) of the innermost origin openings 174. As a result, the innermost radial openings 158 and the innermost origin openings 174 extend along the innermost radial line segments 170, originating at the innermost distance 162 (shown in FIG. 3B) from the apex 142 and extending radially from the apex 142 to the outermost edge 144 of the second layer 22. Because the outermost edge 144 of the second layer 22 is irregularly shaped, the innermost radial line segments 170 have varying lengths, but each innermost radial line segment 170 extends outwardly from an innermost radial opening 158 to the outermost edge 144.

The innermost origin openings 174 on each innermost radial line segment 170 are separated from the innermost radial openings 158 by solid polymer areas 90 and are separated from one another along each innermost radial line segment 170 by solid polymer areas 90 such that the innermost origin openings 174 do not contact one another. The innermost origin openings 174 on each innermost radial line segment 170 that are nearer to the apex 142 are separated by smaller solid polymer areas 90 than innermost origin openings 174 that are farther from the apex 142. Along each innermost radial line segment 170, the innermost origin openings 174 are separated by gradually larger solid polymer areas 90 the farther they are from the apex 142. Additionally, the innermost origin openings 174 on each innermost radial line segment 170 that are nearer to the apex 142 have larger major axis lengths 134 (shown in FIG. 4) than innermost origin openings 174 that are farther from the apex 142. Along each innermost radial line segment 170, the innermost origin openings 174 get gradually smaller the farther they are from the apex 142.

Accordingly, the innermost origin openings 174 enable the second layer 22 to stretch equally around the apex 142. The innermost origin openings 174 provide more stretch nearer to the apex 142 where the innermost origin openings 174 are the largest and are spaced the closest to one another such that the greatest amount of fabric material 74 of the first layer 16 (shown in FIG. 3B) is exposed per unit area. The innermost origin openings 174 provide gradually less stretch, or gradually more support, farther from the apex 142 where the innermost origin openings 174 get gradually smaller and farther from one another and a smaller amount of fabric material 74 of the first layer 16 (shown in FIG. 3B) is exposed per unit area.

In the same manner, in addition to passing through an intermediary radial opening 182, each intermediary radial line segment 194 also passes through a number of intermediary origin openings 198 aligned with each of the intermediary radial openings 194. The intermediary origin openings 198 are substantially similar to the innermost origin openings 174 described above, and are arranged along the intermediary radial line segments 194 such that the intermediary radial line segments 194 pass through the major vertices 118 (shown in FIG. 4) of the intermediary origin openings 198. As a result, the intermediary radial openings 182 and the intermediary origin openings 198 extend along the intermediary radial line segments 194, originating at the intermediary distance 186 (shown in FIG. 3B) from the apex 142 and extending radially from the apex 142 to the outermost edge 144 of the second layer 22. Because the outermost edge 144 of the second layer 22 is irregularly shaped, the intermediary radial line segments 194 have varying lengths, but each intermediary radial line segment 194 extends outwardly from an intermediary radial opening 182 to the outermost edge 144.

The intermediary origin openings 198 on each intermediary radial line segment 194 are separated from the intermediary radial openings 182 by solid polymer areas 90 and are separated from one another along each intermediary radial line segment 194 by solid polymer areas 90 such that the intermediary origin openings 198 do not contact one another. In an analogous manner to the innermost origin openings 174 described above, the intermediary origin openings 198 on each intermediary radial line segment 170 are separated by gradually larger solid polymer areas 90 and get gradually smaller the farther they are from the apex 142.

Accordingly, the intermediary origin openings 198 enable the second layer 22 to stretch equally around the apex 142. The intermediary origin openings 198 provide more stretch nearer to the apex 142 where the intermediary origin openings 198 are the largest and are spaced the closest to one another such that the greatest amount of fabric material 74 of the first layer 16 (shown in FIG. 3B) is exposed per unit area. The intermediary origin openings 198 provide gradually less stretch, or gradually more support, farther from the apex 142 where the intermediary origin openings 198 get gradually smaller and farther from one another and a smaller amount of fabric material 74 of the first layer 16 (shown in FIG. 3B) is exposed per unit area.

In the same manner, in addition to passing through an outermost radial opening 206, each outermost radial line segment 218 also passes through a number of outermost origin openings 222 aligned with each of the outermost radial openings 206. The outermost origin openings 222 are substantially similar to the innermost origin openings 174 described above, and are arranged along the outermost radial line segments 218 such that the outermost radial line segments 218 pass through the major vertices 118 (shown in FIG. 4) of the outermost origin openings 222. As a result, the outermost radial openings 206 and the outermost origin openings 222 extend along the outermost radial line segments 218, originating at the outermost distance 210 (shown in FIG. 3B) from the apex 142 and extending radially from the apex 142 to the outermost edge 144 of the second layer 22. Because the outermost edge 144 of the second layer 22 is irregularly shaped, the outermost radial line segments 218 have varying lengths, but each outermost radial line segment 218 extends outwardly from an outermost radial opening 206 to the outermost edge 144.

The outermost origin openings 222 on each outermost radial line segment 218 are separated from the outermost radial openings 206 by solid polymer areas 90 and are separated from one another along each outermost radial line segment 218 by solid polymer areas 90 such that the outermost origin openings 222 do not contact one another. In an analogous manner to the innermost origin openings 174 described above, the outermost origin openings 222 on each outermost radial line segment 218 are separated by gradually larger solid polymer areas 90 and get gradually smaller the farther they are from the apex 142.

Accordingly, the outermost origin openings 222 enable the second layer 22 to stretch equally around the apex 142. The outermost origin openings 222 provide more stretch nearer to the apex 142 where the outermost origin openings 222 are the largest and are spaced the closest to one another such that the greatest amount of fabric material 74 of the first layer 16 (shown in FIG. 3B) is exposed per unit area. The outermost origin openings 222 provide gradually less stretch, or gradually more support, farther from the apex 142 where the outermost origin openings 222 get gradually smaller and farther from one another and a smaller amount of fabric material 74 of the first layer 16 (shown in FIG. 3B) is exposed per unit area.

Also in the same manner, in addition to passing through a strap portion opening 230, each strap portion line segment 242 also passes through a number of strap origin openings 246 aligned with each of the strap portion openings 230. The strap origin openings 246 are substantially similar to the innermost origin openings 174 described above, and are arranged along the strap portion line segments 242 such that the strap portion line segments 242 pass through the major vertices 118 (shown in FIG. 4) of the strap origin openings 246. As a result, the strap portion openings 230 and the strap origin openings 246 extend along the strap portion line segments 242, originating at the strap portion distance 234 from the apex 142 and extending radially from the apex 142 to the outermost edge 144 of the second layer 22. Because the outermost edge 144 of the second layer 22 is irregularly shaped, the strap portion line segments 242 have varying lengths, but each strap portion line segment 242 extends outwardly from a strap portion opening 230 to the outermost edge 144.

The strap origin openings 246 on each strap portion line segment 242 are separated from the strap portion openings 230 by solid polymer areas 90 and are separated from one another along each strap portion line segment 242 by solid polymer areas 90 such that the strap origin openings 246 do not contact one another. In an analogous manner to the innermost origin openings 174 described above, the strap origin openings 246 on each strap portion line segment 242 are separated by gradually larger solid polymer areas 90 and get gradually smaller the farther they are from the apex 142.

Accordingly, the strap origin openings 246 enable the second layer 22 to stretch equally around the apex 142. The strap origin openings 246 provide more stretch nearer to the apex 142 where the strap origin openings 246 are the largest and are spaced the closest to one another such that the greatest amount of fabric material 74 of the first layer 16 (shown in FIG. 3B) is exposed per unit area. The strap origin openings 246 provide gradually less stretch, or gradually more support, farther from the apex 142 where the strap origin openings 246 get gradually smaller and farther from one another and a smaller amount of fabric material 74 of the first layer 16 (shown in FIG. 3B) is exposed per unit area.

Taken together, the radial line pattern of openings 34 provides particular targeted support to the wearer's breasts during physical exercise. More specifically, the innermost origin openings 174, the intermediary origin openings 198, the outermost origin openings 222, and the strap origin openings 246 provide graduated support which radiates outwardly along the second layer 22. Because the openings 174, 198, 222, and 246 radiate outwardly from the apex 142, there is a greater amount of solid polymer area 90 farther from the apex 142. Accordingly, the amount of stretch (and the associated elastic modulus) of the second layer 22 varies across any given portion of the second layer 22. Additionally, because the openings 174, 198, 222, and 246 are arranged radially about the apex 142, the direction of stretch is concentric and therefore varies across any given portion of the second layer 22. The particular pattern created by the openings 174, 198, 222, and 246 enables the second layer 22 to stretch a greatest amount immediately surrounding the apex 142. This enables the second layer 22 to accommodate and conform to a breast most easily around the apex 142 to comfortably support the most sensitive portion of the breast. The pattern also enables the second layer 22 to stretch a least amount farthest from the apex 142, for example along the strap 46 and near the sternum area 58, side areas 42, and bottom band 50 of the bra 10 (shown in FIG. 1A and FIG. 1B). This enables the second layer 22 to provide the greatest amount of additional support along the outermost edge 144 of the second layer 22 to secure the breasts and reduce movement of the breasts as much as possible during physical exercise.

Figure 6:
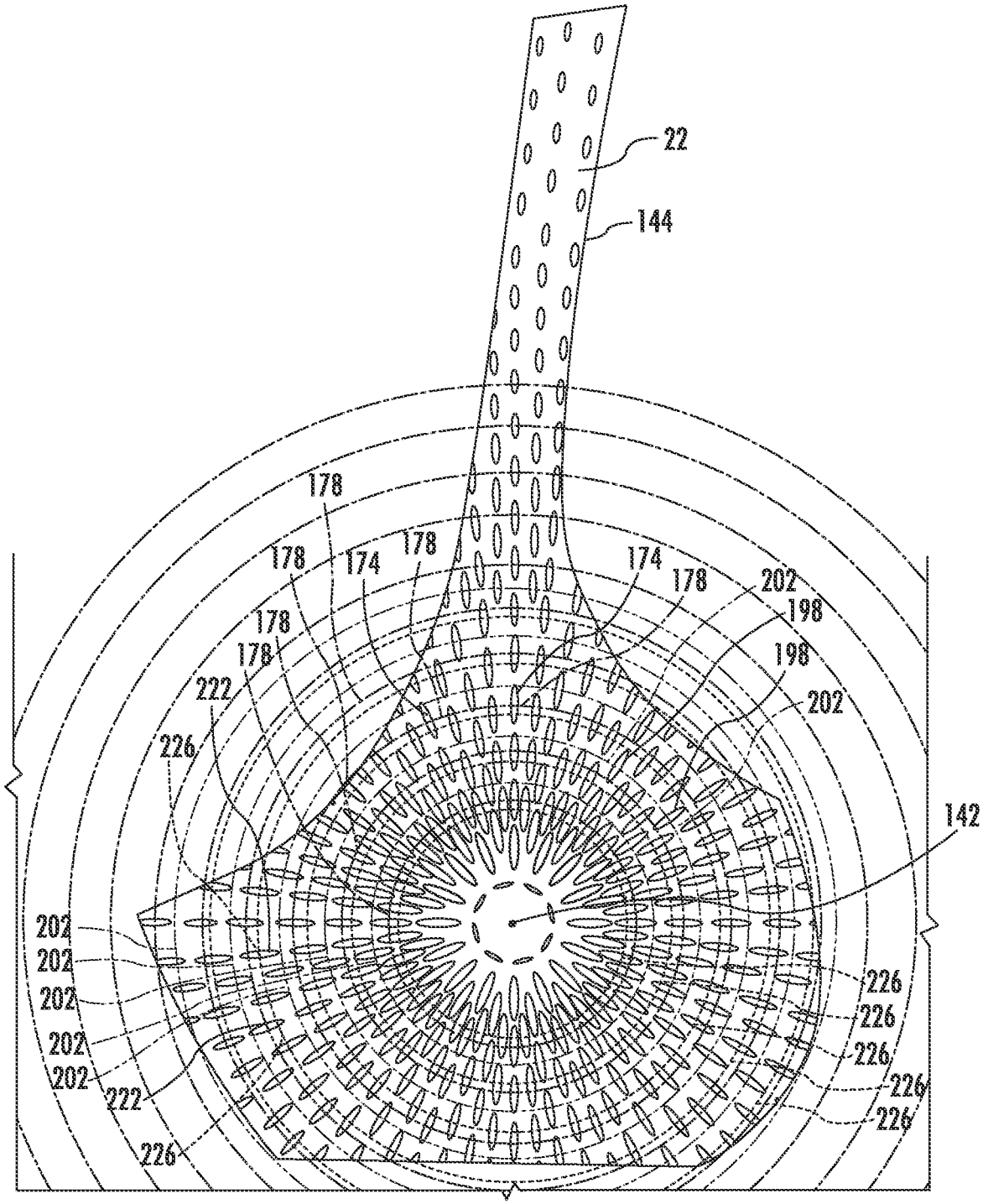
FIG. 6 shows a plan view of a front side of the second layer of FIG. 2 including a plurality of concentric circles.

Turning now to FIG. 6, the innermost origin openings 174 on each innermost radial line segment 170 (shown in FIG. 5) are congruent with the innermost origin openings 174 on the other innermost radial line segments 170. Accordingly, the innermost origin openings 174 are arranged in innermost origin concentric circles 178 each of which is centered about the apex 142. Similarly, the intermediary origin openings 198 on each intermediary radial line segment 194 (shown in FIG. 5) are congruent with the intermediary origin openings 198 on the other intermediary radial line segments 194. As a result, the intermediary origin openings 198 are arranged in intermediary origin concentric circles 202 each of which is centered about the apex 142. Additionally, the outermost origin openings 222 on each outermost radial line segment 218 (shown in FIG. 5) are congruent with the outermost origin openings 222 on the other outermost radial line segments 218. Accordingly, the outermost origin openings 222 are arranged in outermost origin concentric circles 226 each of which is centered about the apex 142. Because the outermost edge 144 of the second layer 22 is irregularly shaped and the innermost radial line segments 170, the intermediary radial line segments 194, and the outermost radial line segments 218 (shown in FIG. 5) are, therefore, of varying lengths, some of the innermost origin concentric circles 178, the intermediary origin concentric circles 202, and the outermost origin concentric circles 226 extend beyond the outermost edge 144 of the second layer 22. However, each innermost origin concentric circle 178 includes at least one innermost origin opening 174 and is centered about the apex 142, each intermediary origin concentric circle 202 includes at least one intermediary origin opening 198 and is centered about the apex 142, and each outermost origin concentric circle 226 includes at least one outermost origin opening 222 and is centered about the apex 142.

Taken together, the concentrically circular pattern of openings 34 provides particular targeted support to the wearer's breasts during physical exercise. More specifically, the innermost origin openings 174, the intermediary origin openings 198, the outermost origin openings 222, and the strap origin openings 246 are arranged and configured in a manner to provide graduated support which is arranged concentrically about the apex 142 and the associated central polymer area 146 of the second layer 22. Because the openings 174, 198, 222, and 246 are arranged concentrically about the apex 142 and central polymer area 146, and are positioned along rays extending from the apex 142, the openings 174, 198, 222, and 246 are most dense in the area immediately surrounding the central polymer area 146, and are less dense at areas further removed from the central polymer area 146. Thus, the particular pattern created by the openings 174, 198, 222, and 246 enables the second layer 22 to stretch a greatest amount (i.e., the elastic modulus is lower) immediately surrounding the central polymer area 146 and the second layer stretches the least (i.e., the elastic modulus is higher) in areas further removed from the central polymer area 146. This enables the second layer 22 to accommodate and conform to a breast most easily around the apex 142 to comfortably support the most sensitive portion of the breast. The pattern also enables the second layer 22 to stretch a least amount farthest from the apex 142 and the central polymer area, for example along the strap 46 and near the sternum area 58, side areas 42, and bottom band 50 of the bra 10 (shown in FIG. 1A and FIG. 1B). This enables the second layer 22 to provide the greatest amount of additional support along the outermost edge 144 of the second layer 22 to secure the breasts and reduce movement of the breasts as much as possible during physical exercise.

The foregoing detailed description of one or more embodiments of the bra having additional support has been presented herein by way of example only and not limitation. It will be recognized that there are advantages to certain individual features and functions described herein that may be obtained without incorporating other features and functions described herein. For example, although a two layer arrangement for the cup panel has been described above including openings in a polymer layer to control the elastic modulus in various regions of the cup panel, it will be recognized that alternative arrangements may be used to control of the elastic modulus in various regions of the cup panel. An example of such an alternative arrangement is a single layer cup panel comprised of an engineered fabric, wherein the elastic modulus provided by the fabric is different in different regions of the cup panel. Thus, a two layer structure is not required to incorporate the varying elastic modulus concept described herein. Moreover, it will be recognized that various alternatives, modifications, variations, or improvements of the above-disclosed embodiments and other features, functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. A brassiere comprising:

a front body portion configured to be positioned along a front of a torso, the front portion comprising:

a body fabric layer including a first, user-facing side and second side opposite the first side, and a discontinuous polymer layer deposited on the body fabric layer, the polymer layer defining covered fabric areas and noncovered fabric areas exposing the body fabric layer, wherein an elastic modulus of the covered fabric areas is different than an elastic modulus of the noncovered fabric areas;

a body back portion coupled to the front portion; and a shoulder strap extending from the front portion to the back portion, the shoulder strap including:

a shoulder fabric layer including a first, user-facing side and second side opposite the first side, and a discontinuous polymer layer deposited onto the second side of the shoulder fabric layer, the polymer layer forming covered fabric areas where the polymer is applied to the fabric layer and openings where the polymer is not applied to the fabric layer, wherein an elastic modulus of the covered fabric areas is different than an elastic modulus of the openings.

2. The brassiere according to claim 1, wherein the front body portion comprises a first cup panel, a sternum area, and a second cup panel.

3. The brassiere according to claim 2, wherein the openings are separated by the covered fabric areas.

4. The brassiere according to claim 3, wherein the openings are shaped to include a major axis and a minor axis.

5. The brassiere according to claim 1, wherein the discontinuous polymer layer deposited onto the front body portion fabric is a printed layer.

6. The brassiere according to claim 1, wherein the polymer layer comprises a printed layer deposited onto the fabric layer, the printed layer forming the covered areas where a polymer is printed onto the fabric layer and openings where the polymer is not printed onto the fabric layer thereby exposing the fabric layer.

7. The brassiere according to claim 1, wherein the openings are dimensioned and arranged on the fabric layer such that a density of the openings is greater in a first region than in a second region.

8. A brassiere comprising:

a body including:

a front body portion configured to be positioned along a front of a torso and a back body portion coupled to the front body portion; and a shoulder strap extending from the front body portion to the back body portion, wherein the brassiere further comprises:

a fabric layer comprising a four-way stretch fabric, and a polymer sheet applied to fabric layer, the polymer sheet configured to provide an elastic modulus gradient along the brassiere.

9. The brassiere according to claim 8, wherein the polymer sheet comprises a plurality of openings operable to permit the passage of heat and/or moisture.

10. The brassiere according to claim 9, wherein one or more openings of the plurality of openings is configured to buckle under an applied stretching force.

11. The brassiere according to claim 9, wherein the plurality of openings includes an array of openings patterned such that a density of the openings varies along the polymer sheet.

12. The brassiere according to claim 9, wherein the plurality of openings includes openings of varying shapes and sizes.

13. The brassiere according to claim 9, wherein:

the plurality of openings includes openings shaped to possess a major axis and a minor axis; and the polymer sheet is further configured to provide the brassiere with a first degree of stretch in a first direction and a second degree of stretch in a second direction.

14. The brassiere according to claim 8, wherein:

the fabric layer is a first fabric layer; and the brassiere further comprises a second fabric layer positioned over the polymer sheet.

15. A brassiere comprising:

a body including:

a front body portion configured to be positioned along a front of a torso and a back body portion coupled to the front body portion; and a shoulder strap extending from the front body portion to the back body portion, wherein the brassiere further comprises:

a fabric layer and a polymer sheet applied to an area of the fabric, the polymer sheet comprising a plurality of openings exposing the fabric layer, wherein openings of the plurality of openings are configured to buckle under an applied stretching force.

16. The brassiere according to claim 5, wherein the plurality of openings includes openings of varying shapes and sizes.

17. The brassiere according to claim 5, wherein the plurality of openings includes openings shaped to include a major axis and a minor axis.

18. The brassiere according to claim 5, wherein the plurality of openings includes an array of openings patterned such that a density of the openings varies along the polymer sheet.

19. The brassiere according to claim 5, wherein:

the fabric layer possesses a first elasticity;

the polymer sheet possesses a second elasticity that differs from the first elasticity; and applying the polymer sheet to the fabric layer includes a combined structure possessing a third elasticity differing from each of the first elasticity and the second elasticity.

20. The brassiere according to claim 5, wherein:

the fabric layer is a first fabric layer comprising a four-way stretch fabric; and the brassiere further comprises a second fabric layer positioned over the polymer sheet.

* * * * *